US005080357A

United States Patent [19]

Wolf

[11] Patent Number: 5,080,357

[45] Date of Patent: Jan. 14, 1992

[54] GOLF BALL AND TEE SETTING DEVICE

[75] Inventor: August H. Wolf, Sun City, Ariz.

[73] Assignee: Augrich Corporation, Schiller Park, Ill.

[21] Appl. No.: 640,027

[22] Filed: Jan. 11, 1991

[51] Int. Cl.[5] ..... A63B 57/00

[52] U.S. Cl. ..... 273/32.5; 294/19.1

[58] Field of Search ..... 273/32.5; 294/19.1

[56] References Cited

U.S. PATENT DOCUMENTS

| | | | |
|---|---|---|---|
| 2,205,345 | 6/1940 | Christensen | 294/19.2 |
| 2,609,198 | 9/1952 | Armstrong | 273/32 |
| 2,943,856 | 7/1960 | Eimerman | 273/33 |
| 3,013,517 | 12/1961 | Isham | 294/19.1 |
| 3,889,946 | 6/1975 | Setecka | 273/33 |
| 3,904,200 | 9/1975 | Jackle et al. | 273/33 |
| 4,013,295 | 3/1977 | Baughman | 273/162 E |
| 4,034,542 | 7/1977 | Loehr | 294/19.1 |
| 4,526,369 | 7/1985 | Phelps | 273/32 B |
| 4,589,661 | 5/1986 | Attig | 273/32.5 |
| 4,616,826 | 10/1986 | Trefts | 273/32.5 |
| 4,714,250 | 12/1987 | Henthorn | 273/32.5 |
| 4,819,938 | 4/1989 | Hill | 273/32.5 |
| 4,949,961 | 8/1990 | Malano | 294/19.1 |
| 4,951,947 | 8/1990 | Kopfle | 273/32.5 |
| 4,969,646 | 11/1990 | Tobias | 273/32.5 |

FOREIGN PATENT DOCUMENTS

| | | | |
|---|---|---|---|
| 1457651 | 9/1966 | France | 294/19.2 |

*Primary Examiner*—Theatrice Brown
*Attorney, Agent, or Firm*—Olson & Hierl

[57] ABSTRACT

A device is provided for setting a golf ball and an operably associated tee in the ground at a desired location with the operating golfer in a standing position. The device is provided with a pair of articulated jaw assemblies at the lower end portion of an elongated tubular shaft, and a handle jaw-operating lever at the upper end portion of the shaft. Manual squeezing of the lever longitudinally moves an actuation rod within the shaft causing opposed links associated with the rod to pivotably move each jaw assembly outwardly. The respective jaw assemblies coact to hold a golf ball and tee yet are releasable therefrom after the tee has been inserted into the ground as desired. Optionally, a pair of device-associated, retractable, ground penetrating spikes can be utilized to facilitate ball and tee positioning.

7 Claims, 2 Drawing Sheets

GOLF BALL AND TEE SETTING DEVICE

FIELD OF THE INVENTION

This invention relates to a golf ball and tee setting device for positioning a golf ball and an associated tee in the ground at a desired location.

BACKGROUND OF THE INVENTION

Devices for simultaneously positioning a golf ball and an associated tee have previously been described. For example, U.S. Pat. No. 4,616,826 to Thefts discloses a device which includes a pair of pivoting arms mounted at the lower end of an elongated hollow shaft. The arms releasably hold a golf ball and tee. The Thefts device uses a cam action to open the arms which is distinct from, and not equivalent to, a pivotal link action.

Such a cam action is disadvantageous because a foot member of the device must be moved upwardly so that the arms pivot radially in an outwardly direction. The arms are not connected to the foot member or actuating rod member except for slidable movement which occurs upon cam activated movement of the arms relative to the foot member. Thefts provides a single supporting leg that is pivotally supported adjacent the upper end of the hollow shaft and is retained along the shaft by a retainer clip. The Thefts single supporting leg cannot be used unless the Thefts device is inclined. Also, the Trefts device does not include means for longitudinally retracting the leg from the bottom portion of the device.

U.S. Pat. Nos. 4,013,295 and 4,714,250 to Baughman and Henthorn, respectively, and French Patent No. 1,457,651 to Torregrosa each disclose articulated jaws for holding golf balls, but only Baughman and Henthorn disclose jaws which are also suitable for use in concurrently setting a tee. Baughman disadvantageously requires a plurality of biasing spring members for jaw control, and each jaw member below its pivot axis is connected to a different link member with the opposite ends of link members being connected together.

Moreover, Baughman requires an actuating superpositioned block assembly which fits like a cap over the jaw pair and which can be moved vertically and reciprocally to provide jaw articulation. This block assembly requires a separate spring-loaded piston for articulating each jaw member and also a separate spring-loaded piston for applying a yielding axial force against a golf ball held between the pair of jaw members. Because of the number of parts, the relatively sensitive interrelationship therebetween and the complicated assembly procedure, the Baughman device is evidently not practical to make or use.

Henthorn uses a jaw member pair each one of which is cup-shaped. A force must be directly transmitted through the ball during setting to open the jaws. In particular, a chain is pulled upwardly near the setting device shaft top, and the jaws pivot about a common transversely extending pin. The Henthorn device appears to have a possible problem in resetting the jaws to a closed position from an open position so as to achieve a gripping action about a golf ball or tee while the user is in a standing position. Respective weak and strong spring members are required for opening and closing biasing. No auxiliary structure sufficient for including a retractable spike support exists in that device.

The art needs an improved, reliable, yet relatively simple, golf ball and tee setting device which overcomes the problems associated with prior art devices and which enables a golfer, particularly a golfer with back problems, to operate the device from a standing position without complicated or required delicate movements.

SUMMARY OF THE INVENTION

This invention relates to a new and very useful device for setting a combination of golf ball and tee in the ground at a desired location while the operating golfer is in a standing position using manual gripping action.

In the device, a pair of articulated jaw members at the lower end portion of an elongated tubular shaft is operated from the upper shaft end portion by a lever which moves relative to a fixed handle. Manual squeezing with a hand positioned around the handle and the lever causes longitudinal movement of an actuation rod extending within the shaft. This pivotally moves each one of a pair of opposed links and results in articulated symmetrical swinging movements of respective members of a jaw member pair.

A golf ball and tee are held within and between the closed jaw members. When the tee is implanted in the ground at the desired location, the jaw members are opened by the pivotable link action, and the device is separated from the golf ball and tee assembly.

Optionally, but preferably, the device is also provided with a pair of longitudinally (relative to the tubular shaft) retractable ground-penetrating positioning spike members which selectively operate and function independently of the jaw assemblies. The spike members can be employed for various functions, such as for precisely prepositioning a tee at a ground location relative to a golf ball before the tee is set with the associated golf ball.

The ground-implanted spike members also facilitate controlled vertical movement of the device away from the positioned ball and tee without additional contact between the ball or tee and the lower portion of the device. Even such incidental contact can knock the ball off the tee. Moreover, the spike members allow the device to be maintained in a vertical orientation when not in use.

The device can be used to extract and remove tees, and to pick up golf balls. The device permits a golfer, such as a golfer with a back problem, either to position and set, or to pick up a golf ball and its supporting tee without bending over and with a minimum of body movements. The device can also be used by a handicapped golfer as a walking aid.

Other and further objects, benefits and advantages will be apparent to those skilled in the art from the accompanying drawings, the present description and the appended claims.

DETAIL DESCRIPTION

Figures 1, 2, 3, 4:
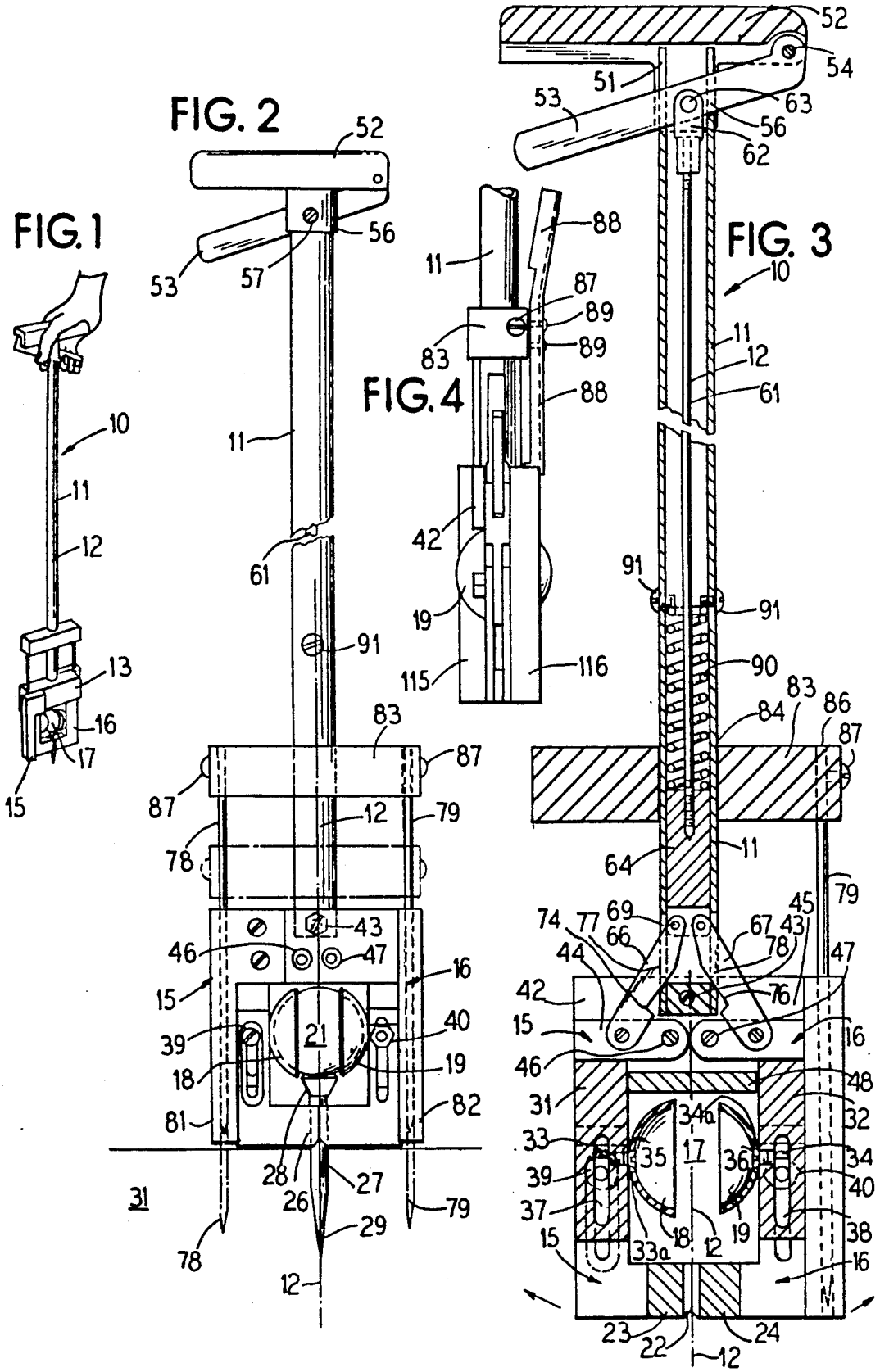
FIG. 1 is a perspective view of one embodiment of a device of the present invention.
FIG. 2 is an enlarged side elevational view of the embodiment shown in FIG. 1 including a combination of engaged golf ball and tee and with the tee positioned in the ground, the spike members retracted, some parts thereof being broken away, and with the position of the spike members when extended being shown in phantom.
FIG. 3 is an enlarged vertical sectional view in side elevation of the device embodiment shown in FIGS. 1 and 2, some parts thereof being broken away, and with the spike subassembly in a retracted configuration.
FIG. 4 is a fragmentary end elevational view of the device embodiment shown in FIGS. 1 through 3 taken in the region of the articulated jaws and spike subassembly with the latter being shown in a retracted configuration.

Referring to the drawings, FIGS. 1–4 show one embodiment 10 of the present invention. Device 10 incorporates an elongated tubular shaft 11 having a longitudinal axis 12. One end 13 (the lower end when device 10 is in use) of shaft 11 is associated with a pair of articulated jaw members 15 and 16 which are adapted to symmetrically, pivotally and diametrically articulate relative to one another and to the axis 12. The articulation is between the normally closed configuration shown in the Figures and an open configuration.

The pair of jaw members 15 and 16 cooperate to define therebetween (symmetrically relative to the axis 12) a central golf ball holding region of chamber 17. Each jaw member encloses and longitudinally circumscribes about one half of the chamber 17 which has, in the embodiment 10, a generally rectangular perimeter in side elevation, while the opposed sides of the central chamber 17 adjacent to the respective jaw members 15 and 16 are open.

Each jaw member 15 and 16 is provided with a pocket defining member 18 and 19, respectively, which are both located in the holding chamber 17, but in a diametrically opposed relationship relative to the axis 12. The pocket defining members 18 and 19 are adapted to cooperate with one another so as to hold a golf ball 21 therebetween when the jaws 15 and 16 are in the closed position as shown.

In the device 10, each member 18 and 19 defines a pocket that is shaped as a spherical segment (presently preferred). The members 18 and 19 are each comprised of a somewhat resilient, but shape retentive, plastic composition for ready comformability to, and for frictional, but non-intrusive (i.e. non-scratching, and non-abrading) association with, the golf ball 21. The relationship between the members 18 and 19 and their respective associated jaws 15 and 16 is preferably such that, when the jaws 15 and 16 are articulated and opened to their fully opened positions, the golf ball 21 is insertable therebetween from a side position. The bottom aperture therebetween when the jaws 15 and 16 are opened is such that the ball 21 is readily releasable or insertable therethrough.

The pair of jaw members 15 and 16 further cooperate to define therebetween an axial channel 22 with up to about one longitudinal half of channel 22 being in each respective jaw member 15 and 16, respectively. See FIG. 3. Channel 22 extends axially, forwardly and downwardly from the central chamber 17 through the respective jaw members 15 and 16 to the forward (lowermost) ends 23 and 24. In this manner, the medial shaft region 26 of a tee 27 is positionable and holdable therebetween when the jaw members 15 and 16 are in their closed configuration. See FIG. 2.

During the holding operation, the head 28 of the tee 27 is engagable with an exterior spherical surface portion of the golf ball 21 while the ground-engaging forward end portion 29 of the tee 27 projects forwardly from the jaw members 15 and 16, as illustrated, for example, in FIG. 2. Also, the spacing between the members 18 and 19 when the jaws 15 and 16 are in their closed configuration is such that the tee head 28 is positionable therebetween against the ball 21.

Each of the pocket defining members 18 and 19 is longitudinally adjustable relative to the shaft axis 12. Thus, in adjacent relationship to the side wall 31 and 32 of each jaw member 15 and 16, each pocket defining member 18 and 19 is mounted to a segmental portion 33 and 34, respectively, of each jaw member 15 and 16 by a set screw 35 and 36, respectively, as desired. The segmental portion 33 and 34 of each jaw member slidably engages and longitudinally moves along an associated channel 37 and 38, respectively, formed therein and also through a mating segment 33A and 34A of each pocket defining member 18 and 19.

To set each segmental portion 33 and 34 in a desired location along channels 37 and 38, respectively, relative to segments 33A and 34A, a clamping nut and bolt assembly 39 and 40, or the like, is used with the bolt portion of each assembly extending through each channels 37 and 38 and also through an aperture formed in each segmental portion 33 and 34.

Thus, when the assembled segments are tightened or clamped together by the assemblies 39 and 40 after the desired positioning is achieved, the segmental portions 33 and 34 are locked in place. By selecting a position for members 18 and 19 relative to channel 22, the longitudinal length of the forward end portion 29 of the tee 27 that enters and engages the ground 31 is adjustable to suit the preference of the user, or the playing conditions, as desired.

Across the end 13 of the shaft 11, a mounting plate 42 is extended which is conveniently held relative to the shaft 11 by a nut and bolt assembly 43 that extends through the shaft 11 adjacent the end 13. The upper or cross arms 44 and 45 of jaw members 15 and 16, respectively, are aligned in abutting adjacent relationship with one another as shown, for example, in FIG. 3 with the adjacent ends being rounded to allow the desired pivotal movements of each jaw member 15 and 16. At the center point of each rounded end, a mounting channel is formed, and each channel is aligned with a corresponding channel in the plate 42. Nut and bolt assemblies 46 and 47 or the like extend through channels and mount each jaw member 15 and 16 for pivotal articulating movements relative to each other. A lower inturned edge portion 48 of the plate 42 in chamber 17 aids to guide and position the jaw members 15 and 16.

The opposite (upper) end 51 of shaft 11 is associated with a transversely extending handle member 52. A jaw activating lever arm 53 is pivotably associated with an end region of handle member 52 by means of a rivet 54 or the like. The pivot axis of arm 53 is thus generally in spaced perpendicular relationship to the shaft axis 11. In device 10, handle member 52 has a bar-like structure which is provided with a projecting sleeve 56 (by welding, molding, or the like) at its central portion which is slidably engagable over the outside portions of shaft 11 adjacent end 51. When so engaged, a set screw 57 or the like that is extended through a side wall of sleeve 56 can be used to fix the position of the handle member 52 relative to the shaft 11. The lever arm 53 is reciprocally movable along the shaft axis 12 in opposed slots 58 formed in the adjacent end 51 of shaft 11 and in the aligned slots 59 formed in sleeve 56.

A rod member 61 extends longitudinally and preferably axially in shaft 11. The upper end portion of rod 61 is threadably engaged with the butt end of a yoke or clevis 62 whose arms are disposed one on each side of the central region of the arm 53. Matching holes in the clevis 62 arms align with a transverse hole in arm 53, and a pin, rivet 63 or the like is extended therethrough so as to journal the clevis arms relative to lever arm 53 for arcuate pivotal movements as the lever arm 53 is pivoted about the rivet 54.

The lower end portion of the rod 61 is threadably received in a piston 64 that is longitudinally slidable within the shaft 11. The piston 64 reciprocates in spaced relationship to the end 13 as the lever arm 15 is pivoted.

A pair of opposed link members 66 and 67 are provided. One end of each link member 66 and 67 is pivotally associated with an end plate 68 formed across piston 64 by means of a rivet 69 and 71, respectively. Each link member extends diagonally outwardly and downwardly towards jaw members 15 and 16 through opposed slots 77 and 78 formed inside the wall portions of the shaft 11. The opposite end of each link member 66 and 67 is pivotally associated with an outer upper edge region of each cross arm 44 and 45, respectively, by means of nut and bolt assemblies 72 and 73, respectively, or the like. Each link member 66 and 67 includes a notch 74 and 76 formed along its respective inside edges. When the piston 64 is moved upwardly, each notch 74 and 76 is adapted to engage the lower end of its associated slot 77 and 78, respectively, thereby limiting outward pivotal travel of each jaw member 15 and 16 and avoiding structural interference with the shaft 11 as the jaw articulation occurs.

A coiled compression spring 90 is slidably positioned in the shaft 11 in the region which overlies the piston 64 but below a pair of opposed set screws 91 (or the like) which threadably extend through shaft 11 in opposed relationship to each other. The set screws 91 maintain a yielding spring bias between the shaft 11 and piston 64 thereby producing a biasing force which tends to maintain the jaw member 15 and 16 in a normally closed engagement.

Thus, when a golf ball 21 and a tee 27 are held by the jaw members 15 and 16 with the tee head 28 engaged with the ball 21, as described above, pivotal movements of the activating lever arm 53 produce articulation of the jaw members when the exposed tip region 29 is engaged with the ground 31, thereby releasing the so engaged tee 27 and ball 21 and leaving the ball 21 resting on the tee 27 when device 10 is separated therefrom.

Device 10 is further preferably provided with a pair of elongated extensible and retractable spikes 78 and 79 which longitudinally extend in spaced, generally parallel relationship to each other and to the axis 12. Such spikes 78 and 79 are employed in combination with a pair of elongated sleeves 81 and 82 each one of which slidably receives therethrough one of the spike members 78 and 79, respectively. Each sleeve 81 and 82 is in spaced, parallel relationship to the shaft axis 12, and also is in a functionally non-interfering, adjacent longitudinal relationship along the outside of a different one of the jaw members 15 and 16.

An upper transversely extending integral portion of the mounting plate 42 serves as a cross tree means to which a corresponding respective top portion of each sleeve 81 and 82 is affixed by screw means or the like (not shown). Relative to the jaw members 15 and 16, each sleeve 81 and 82 is offset from the other to avoid interference with jaw articulation. In the device 10, the sleeves 81 and 82 each have a length that is about equal to the length of the side walls 31 and 32, respectively.

A cross bar member 83 extends across, and is in longitudinally slidable engagement with, portions of shaft 11 which extends through and are adjacent to a centering hole 84 formed therein. Opposite end regions of the cross bar member 83 are each provided with a channel 86 through which the upper end portion of each spike 78 and 79 is slidably extendable. The position of each spike 78 and 79 relative to its associated channel 86 is fixed by means of a set screw 87 or the like.

Preferably, the limits of up and down oscillatory longitudinal movement of the cross bar member 83 are so set that in the down position, spikes 78 and 79 extend a desired distance forwardly of the jaw members 15 and 16 with the cross bar member 83 abutting against the top of the plate 42. While in the uppermost position, the spikes 78 and 79 are withdrawn to an extent such that no exposed portions thereof project below the sleeves 81 and 82, respectively. The cross bar member 83 is preferably provided with an associated stop clip member 88 which is held to the bar 83 by screws 89 or the like and which is adapted to limit the travel of the cross bar member 83 to the desired extent.

Thus, the spike members 81 and 82 are extensible and retractable forwardly of the jaw members 15 and 16 to temporarily position the device 10 in the ground without functional interference with the pivotal movement of the jaw members 15 and 16 when a golf ball and tee are being positioned. The spike members also provide for controlled removal of the device away from the positioned ball and tee. This avoids incidental contact between the device and the ball or the tee which could knock the ball from the tee. The spike members can also be used to maintain the device in a readily accessible, upright position when not in use.

Figure 5:
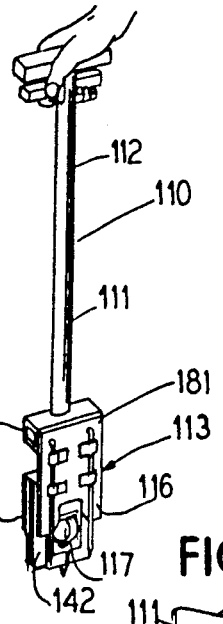
FIG. 5 is a view similar to FIG. 1, but shows another embodiment of a device of the present invention.
Figure 7:
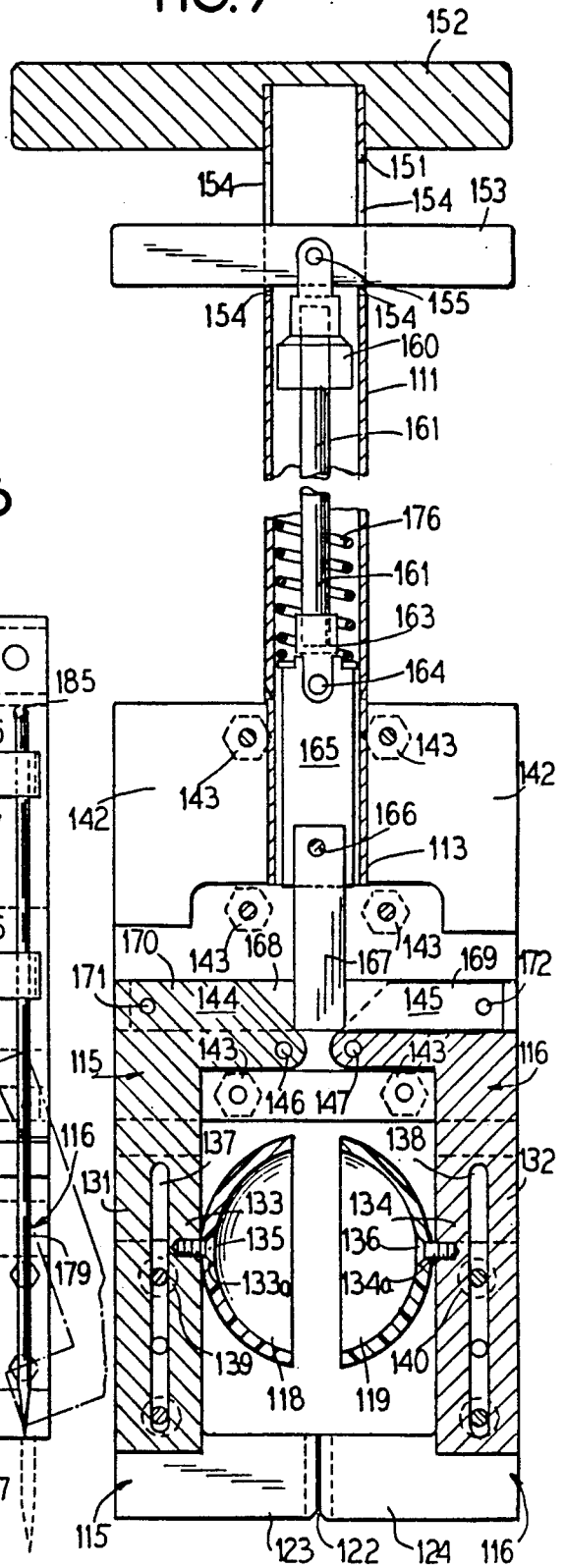
FIG. 7 is an enlarged vertical sectional view of the embodiment shown in FIGS. 5 and 6, some parts thereof being broken away.
Figure 8:
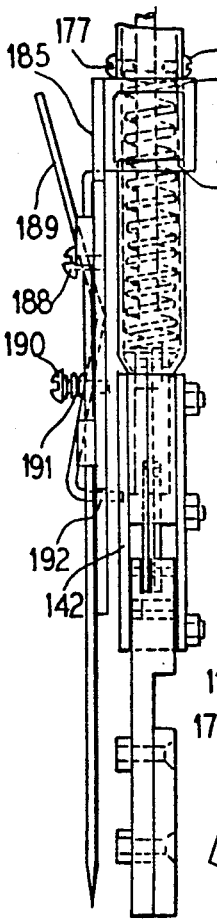
FIG. 8 is a fragmentary end elevational view of the device embodiment shown in FIGS. 5 through 7 taken in the region of the articulated jaws and spike subassembly with the latter being shown in a retracted configuration.
Figure 6:
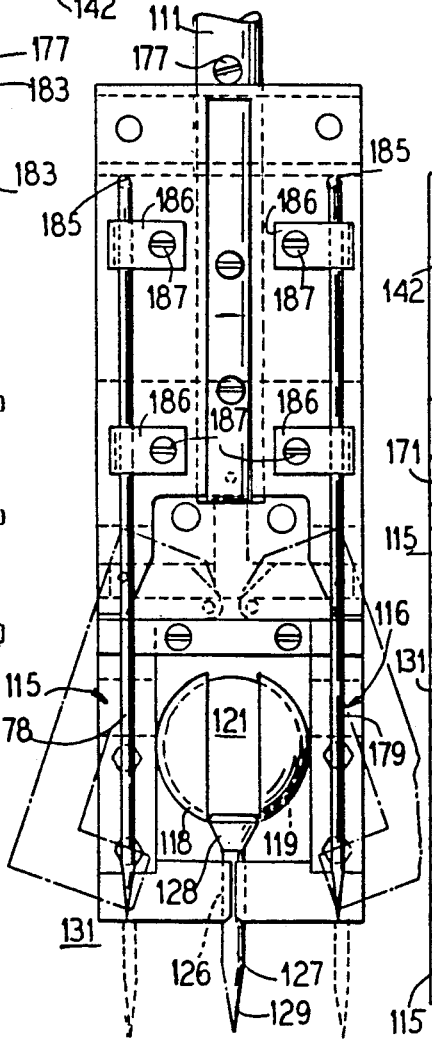
FIG. 6 is an enlarged side elevational view of the embodiment shown in FIG. 5 including a combination of engaged golf ball and tee, with the spike members retracted, some parts thereof being broken away, and with the respective positions of each of the spike members and of the jaws when extended being shown in phantom.

Referring to FIGS. 5 through 8, there is seen another embodiment 110 of the present invention. Device 110 incorporates an elongated tubular shaft 111 having a longitudinal axis 112. One end 113 (the lower end when device 110 is in use) of the shaft 111 is associated with a pair of articulated jaw members 115 and 116 which are adapted to symmetrically, pivotally and diametrically articulate relative to one another and to the axis 112. The articulation is between the normally closed configuration shown in the Figures and an open configuration as shown in FIG. 6.

The pair of jaw members 115 and 116 cooperate to define therebetween a central golf ball holding region of chamber 117. Each jaw member encloses and longitudinally circumscribes about one half of the chamber 117 which has, in the embodiment 110, a generally rectangular perimeter in side elevation. While the opposed sides of such central chamber 117 adjacent to the respective jaw members 115 and 116 are open.

Each jaw member 115 and 116 is provided with a pocket defining member 118 and 119, respectively, which are both located in the holding chamber 117, but in a diametrically opposed relationship relative to the axis 112. The pocket defining members 118 and 119 are adapted to cooperate with one another so as to hold therebetween a golf ball 121 therebetween when the jaws 115 and 116 are in the closed position as shown.

In the device 110, each member 118 and 119 defines a pocket that is shaped as a spherical segment (presently preferred). The members 118 and 119 each comprise a somewhat resilient, but shape retentive, plastic composition for ready comformability to, and for frictional, but non-intrusive (i.e. non-scratching, and non-abrading) association with, the golf ball 121. The relationship between the members 118 and 119 and their respective associated jaws 115 and 116 is preferably such that, when the jaws 115 and 116 are articulated and opened to their fully opened positions, (see FIG. 6), the golf ball 121 is insertable therebetween from a side position. The bottom aperture therebetween when the jaws 115 and 116 are opened is such that the ball 121 is readily releasable or insertable therethrough.

The pair of jaw members 115 and 116 further cooperate to define therebetween an axial channel 122 with up to about one longitudinal half of channel 122 being in each respective jaw member 115 and 116, respectively. Channel 122 extends axially, forwardly and downwardly from the central chamber 117 through the respective jaw members 115 and 116 to the forward (lowermost) ends 123 and 124. In this manner, the medial shaft region 126 of a tee 127 is positionable and holdable therebetween when the jaw members 115 and 116 are in their closed configuration.

In such a position, the head 128 of the tee 127 is engagable with an exterior spherical surface portion of the golf ball 121 while the ground-engaging forward end portion 129 of the tee 127 projects forwardly from the jaw members 115 and 116, as illustrated, for example, in FIG. 6. Also, the spacing between the members 118 and 119 when the jaws 115 and 116 are in their closed configuration is such that the tee head 128 is positionable therebetween against the ball 121.

Each of the pocket defining members 118 and 119 is longitudinally adjustable relative to the shaft axis 112. Thus, in adjacent relationship to the side wall 131 and 132 of each jaw member 115 and 116, each pocket defining member 118 and 119 is mounted to a segmental portion 133 and 134, respectively, of each jaw member 115 and 116 by a set screw 135 and 136, respectively, as desired. Each segmental portion 133 and 134 slidably engages and longitudinally moves along an associated channel 137 and 138, respectively, formed therein and also through a mating segment 133A and 134A of each pocket defining member 118 and 119.

To set each segmental portion 133 and 134 in a desired location along channels 137 and 138, respectively, relative to segmental portions 133A and 134A, a clamping nut and bolt assembly 139 and 140, or the like, is used with the bolt portion of each assembly extending through each channel 137 and 138 and also through an aperture formed in each segmental portion 133 and 134.

Thus, When the assembled segments are tightened or clamped together by the assemblies 139 and 149 after a desired positioning is achieved and the segmental portions 133 and 134 are locked in place. By selecting a position for members 118 and 119 relative to channel 122, the longitudinal length of the forward end portion 129 of the tee 127 that enters and engages the ground 131 is adjustable to suit the preference of the user.

Adjacent the lower end 113 of shaft 111, a section of shaft 111 is formed into a rectangular configuration and a pair of side plates 142 are fixed thereto in spaced parallel relationship to one another by means of a plurality of nut and bolt assemblies 143 (preferably six in embodiment 110). The upper or cross arms 144 and 145 of jaw members 115 and 116, respectively, are positioned in aligned but spaced relationship with one another as shown, for example, in FIG. 7 with the adjacent ends being beveled to allow the desired pivotal movement of each jaw member 115 and 116. At the pivot point of each so rounded arm end, a mounting channel is formed therethrough and each such channel is aligned with a corresponding channel in the side plates 142. Pivot pins 146 and 147 or the like extend through the channels and mount each jaw member 115 and 116 for pivotal articulating movement relative to each other. The side plates 142 aid in guiding the jaw members 115 and 116.

The opposite (upper) end 151 of shaft 111 is associated with a transversely extending handle member 152. A jaw activating lever arm 153 transversely extends through, and is pivotably associated with, diametrically opposed slotted apertures 154 formed the adjacent end 151 of the shaft 111. A rivet 155 or pin through a mid region of level arm 153 associates lever 153 with the forked or clevis-equipped upper end of a rod member 161 which extends axially downwardly through shaft 111. A spacer collar 160 about the upper end serves to center the rod 161 and lever arm 153 relative to the shaft 111. When the lever arm 153 is reciprocally moved in slotted apertures 154, the rod member 161 is reciprocally moved.

The lower end portion of rod 161 is engaged (preferably threadably) to a clevis 163 which is mounted by a pin 164 to the upper end of a plate 165 which is adapted to reciprocate in the terminal rectangular configuration of shaft 111 at lower end 113.

The lower end of plate 165 is associated by a pin 166 with each one of a pair of L shaped links 167 and 168 each one being located on a different side of plate 165, and the arm 169 and 170, respectively, of each link being outturned relative to the other. Each link member extends outwardly and downwardly towards jaw members 115 and 116 through opposed slots formed in side wall portions of shaft 111. The end of the outturned arm of each link member 167 and 168 is pivotally associated by respective pins 171 and 172 with an outer upper edge region of each cross arm 144 and 145, respectively. When plate 165 is pulled upwards as the level arm 153 is longitudinally moved relative to the shaft 111 towards the handle member 152, the jaw members 115 and 116 reciprocally articulate outwards and pivot about respective pins 146 and 147. The limit of travel occurs when each link 167 and 168 abuts against the mid region of each pair of nut and bolt assemblies 143.

A coiled compression spring 176 is slidably positioned in shaft 111 in the region which overlies the plate 165 and below a pair of set screws 177 (or the like) which threadably extend through the shaft 111 in opposed relationship to each other. The set screws maintain a yielding spring bias between shaft 11 and the plate 165 thereby producing a biasing force which tends to maintain the jaw members 115 and 116 in a normally closed engagement relative to each other.

Thus, when a golf ball 121 and a tee 127 are held by the jaw members 115 and 116 with the tee head 128 engaged by the ball 121, as described above, longitudinal movements of the activating lever arm 153 produce articulation of the jaw members 115 and 116. When the tee 127 is placed in the ground, the tee 127 and the ball 121 can be positioned so that the ball 121 rests on the tee 127 when device 110 is separated therefrom.

Device 110 is further preferably provided with a pair of elongated extensible and retractable spike members 178 and 179 that longitudinally extend in spaced, generally parallel relationship to each other and to the axis 112. The spike members 178 and 179 are employed in combination with an elongated plate 181. As described with regard to the foregoing embodiment, the spike members facilitate placement of the ball and tee and also provide for controlled removal of the device without additional contact between the device and the ball or the tee.

The upper portion of the plate 181 is folded with three right-ankle bends to define a square section 182 (see FIG. 5). A pair of apertures 183 formed in the mid-region section 182 permit the section 182 to be slidably engaged with the shaft 111 along a region which is above the rectangularly formed bottom section of shaft 111. Thus, one face of the plate 181 is slidably engagable with one face of a side plate 142.

The upper end of each spike 178 and 179 is bent or inturned at an angle of preferably about 90 degrees relative to the spike shaft, and a pair of transversely spaced holes 185 is formed in plate 181 just below square section 182 thereof. Each hole 185 is adapted to accommodate the inturned end of each spike 178 and 179. The spikes 178 and 179 are maintained in spaced, parallel relationship to one another and in adjacent relationship to the outside face of plate 181 by means of clips 186 (one pair per spike) which are each secured to the plate 181 by a set screw 187.

The limits of up and down oscillatory longitudinal movement of the plate 181 are set so that in the down position, spikes 178 and 179 extend a desired distance beyond the jaw members 115 and 116 such as shown in phantom in FIG. 6 with the square section abutting against the top of the assembly of plates 142. While in the uppermost position, spikes 178 and 179 are withdrawn so that no exposed portions thereof project below the jaws 115 and 116. The plate 181 is preferably provided with an associated elongated stop member 189 which is in the form of a fork with a bent shank and which includes an upper portion that is pivotally held to the plate 181 by a screw 188 or the like.

Stop member 189 is yielding biased in a closed position by a biasing compression spring 191 applied thereto along the shank of a retaining screw 190 mounted in the plate 181. A bent tine 192 in the forward end of stop member 189 extends through an aperture formed in the plate 181 for receipt in a mating aligned holding aperture in the adjacent plate 142. With the tine 192 engaged with a holding aperture, plate 181 is locked in a fixed position. Preferably there are at least two holding apertures in plate 142.

Although the present invention is described with reference to particular embodiments, other and further embodiments will be apparent to those skilled in the art, and no undue limitations are intended based on the present description.

What is claimed is:

1. A golf ball and tee setting device comprising:

an elongated tubular shaft having a longitudinal axis;

a pair of opposed jaw members operatively connected to one end of said shaft including means for pivotally moving each jaw member relative to the other towards and away from said shaft longitudinally axis, said pair of jaw members each including cooperative means for holding a golf ball therebetween when said jaw members are in a closed position, said pair of jaw members further defining a channel extending coaxially with the longitudinal axis of said shaft for holding a golf tee so that the head of said tee engages the golf ball while the ground-engaging end portion of said tee extends a predetermined distance from said jaw members when said jaw members are in a closed position;

handle means connected to the opposite end of said shaft including actuating lever means for operating said pair of jaw members;

means extending within said shaft including clevis means for attaching one end thereof with said lever means, and slide means attached to the opposite end thereof, said slide means being longitudinally slidable within said shaft adjacent said jaw members;

a pair of opposed link members each link member having one end portion pivotally attached to said slide means and an opposite end portion which extends outwardly away from said shaft; and spring means located within said shaft for yieldingly biasing said pair of jaw members into a normally closed configuration;

so that movement of said activating lever means relative to said handle means produces articulation of said jaw members when the end portion of said tee is implanted in the ground, thereby releasing the so engaged tee and golf ball, and leaving said golf ball resting on said tee when the device is separated therefrom.

2. The device of claim 1 wherein said actuating lever means is pivotable about an axis which is generally in spaced, perpendicular relationship to said shaft axis.

3. The device of claim 1 wherein said actuating lever arm means reciprocates and is slidably movable with said shaft adjacent said handle means.

4. The device of claim 1 wherein each of said cooperative holding means is longitudinally adjustable relative to said shaft axis, and is provided with means for adjustment, so that said holding means is positionable axially to regulate the longitudinal length of said ground-engaging tee end portion.

5. The device of claim 4 wherein each of said cooperative holding means includes a pocket that is configured as a spherical segment.

6. The device of claim 1 wherein each of said link members is pivotally connected to its associated jaw member at an outer upper edge region thereof.

7. The device of claim 1 which further includes:

a pair of longitudinally extending, spaced, parallel spike members;

support means for said spike members which slidably engages said shaft; and stop means limiting the upward and downward travel of said support means.

* * * * *